US011583748B2

(12) United States Patent
Siudzinski et al.

(10) Patent No.: US 11,583,748 B2
(45) Date of Patent: Feb. 21, 2023

(54) TENNIS TEACHING TOOL

(71) Applicants: David Alexander Siudzinski, East Northport, NY (US); John Carlo Manigaulte, Kings Park, NY (US)

(72) Inventors: David Alexander Siudzinski, East Northport, NY (US); John Carlo Manigaulte, Kings Park, NY (US)

( * ) Notice: Subject to any disclaimer, the term of this patent is extended or adjusted under 35 U.S.C. 154(b) by 0 days.

(21) Appl. No.: 17/304,892

(22) Filed: Jun. 28, 2021

(65) Prior Publication Data

US 2022/0409978 A1 Dec. 29, 2022

(51) Int. Cl.
*A63B 69/38* (2006.01)

(52) U.S. Cl.
CPC ..... *A63B 69/38* (2013.01); *A63B 2214/00* (2020.08)

(58) Field of Classification Search
CPC .... A63B 69/38; A63B 69/385; A63B 2214/00
See application file for complete search history.

(56) References Cited

U.S. PATENT DOCUMENTS 3,540,726 A 11/1970 Davis
3,876,203 A * 4/1975 Gold ..... A63B 69/0091 473/417
3,999,753 A 12/1976 Desilets et al.
4,022,467 A * 5/1977 Ruess ..... A63B 69/0091 473/464
4,032,145 A 6/1977 Tami
4,049,266 A * 9/1977 Feiler ..... A63B 69/0079 473/145
4,079,934 A 3/1978 Nixon
4,089,521 A * 5/1978 Berst ..... A63B 69/0091 473/429
4,191,372 A * 3/1980 Keller ..... A63B 69/0075 273/DIG. 30
4,204,678 A 5/1980 Weis
4,269,410 A 5/1981 Martin
4,417,730 A * 11/1983 Weiner ..... A63B 69/0091 473/426
4,460,172 A 7/1984 Hogan
4,531,734 A 7/1985 Herrick
(Continued)

FOREIGN PATENT DOCUMENTS

DE 202013001474 U1 * 4/2013 ..... A63B 15/00
GB 2278288 A * 11/1994 ..... A63B 69/0079
(Continued)

*Primary Examiner* — Raleigh W Chiu
(74) *Attorney, Agent, or Firm* — Dunlap Bennett & Ludwig, PLLC

(57) ABSTRACT

A teaching tool for use by an instructor teaching proper footwork and effective swing techniques to students of the game of tennis as well as to students of other racket-based sports. The teaching tool provides an elongated member and a mounting member extending perpendicularly from the distal end of the elongated member. A target object is connected to the distal end of the mounting member. The target object and distal end of the elongated member may be separated by a target distance defined, in part, by the size of racket the student is using. In use, the instructor can directly and selectively control the movement of the target object to simulate imparted spin and motion of the target object before and after the student strikes the target object.

4 Claims, 2 Drawing Sheets

(56) References Cited

U.S. PATENT DOCUMENTS 4,577,864 A * 3/1986 Aldrich ..... A63B 69/0088 473/424
4,735,413 A 4/1988 Yamanouchi et al.
4,865,319 A * 9/1989 Drazinakis ..... A63B 69/0079 473/418
4,989,867 A 2/1991 Herrick
5,222,732 A * 6/1993 Robey ..... A63B 69/38 473/459
5,386,988 A * 2/1995 Sung ..... A63B 69/0079 473/423
5,427,369 A 6/1995 Baquet, Jr.
5,433,435 A * 7/1995 Bourie ..... A63B 69/0079 473/576
5,458,327 A * 10/1995 Crespin ..... A63B 69/0088 473/576
5,685,542 A * 11/1997 Weis ..... A63B 69/0091 588/1
6,099,419 A 8/2000 Incaudo et al.
7,115,052 B2 10/2006 Wardle et al.
7,691,013 B2 * 4/2010 Emerson ..... A63B 69/0088 473/424
7,775,911 B2 * 8/2010 Zappel ..... A63B 69/0002 473/422
8,137,218 B2 3/2012 Le niewicz
9,072,954 B2 * 7/2015 Riggle ..... A63B 69/0002
2001/0036874 A1 11/2001 Cathcart
2006/0014597 A1 * 1/2006 Cantu ..... A63B 69/0002 473/424
2006/0035729 A1 * 2/2006 Wang ..... A63B 69/0073 473/417
2007/0123373 A1 * 5/2007 Emerson ..... A63B 69/385 473/464
2007/0238556 A1 * 10/2007 Gipple ..... A63B 69/38 473/461
2010/0009783 A1 * 1/2010 Bozarth ..... A63B 69/385 473/419
2011/0275459 A1 * 11/2011 Polich ..... A63B 69/385 473/462
2017/0259153 A1 * 9/2017 Fiedler ..... A63B 69/385
2018/0021649 A1 * 1/2018 Gong ..... A63B 71/0045 473/419
2019/0083872 A1 * 3/2019 Dunford ..... A63B 1/00
2022/0008798 A1 * 1/2022 Fuchs ..... A63B 71/0622

FOREIGN PATENT DOCUMENTS

WO WO-2020100137 A1 * 5/2020 ..... A63B 24/0062
WO WO-2020122515 A1 * 6/2020 ..... A63B 43/007

* cited by examiner

TENNIS TEACHING TOOL

BACKGROUND OF THE INVENTION

The present invention relates to the game of tennis and is, more particularly, a tennis teaching tool that can be used to simulate a ball-in-motion.

Moving tennis balls are very hard to hit not only for beginning students but also for professionals who want to learn or develop new techniques (which are best taught with a ball in simulated slow motion). Current tools for teaching tennis strokes are not under the instructor's direct control and as a result these tools fail to provide tennis instructors the opportunity to produce consistently very specific trajectories students need to respond to in order to succeed with particular tennis drills.

Prior to this invention, tennis players would have to hit a moving tennis ball that is not precisely directed by the instructor. This invention enables instructors to issue instructions in slow motion so that students can more quickly learn beginning and advanced techniques.

As can be seen, there is a need for a tennis teaching tool enabling the instructor to directly and selectively control the movement of the tennis ball through various positions, various trajectories, various arcs, and at various speeds. Because this invention presents a real tennis ball at a 90-degree angle to the embodiment of the tool, it thereby enables instructors to visually demonstrate how various spins are imparted to a tennis ball; for example, by simulating tennis balls moving in slow motion the instructor can advise students to alter their footwork, their pre-swing motions, and the angle at which they cause their rackets to strike the tennis ball. In addition, this static tennis ball extension tool allows instructors to hold a tennis ball stationary in the air, allowing students to practice (in slow motion) skills that occur at a much faster speed.

SUMMARY OF THE INVENTION

The present invention is a device that includes the following: an elongated portion; a mounting portion extending perpendicularly from the distal end of the elongated portion; and a target object (a real tennis ball) connected to the distal end of the mounting portion, wherein a specified target distance separates the target object and said distal end.

In another aspect of the present invention, the target object is extended approximately three inches and at a 90-degree angle from the elongated portion, wherein the elongated portion has a length of approximately forty-six inches. An elbow connector connects the elongated portion with the mounting portion, which is approximately three inches in length. With the exception of the target object, the tool may be made from polyvinyl carbonate (PVC), which has a Durometer hardness within the range of 40A to 90D. The target object is a spheroid, wherein the spheroid has a hole slidably receiving the distal end of the mounting portion; an adhesive adheres the elbow connector to the elongated portion and the mounting portion; and an end cap is attached to the proximal end of the elongated portion, wherein there is no pivotable connection between the target object and the mounting portion.

In yet another aspect of the present invention, instructors can simulate the movement of a spheroid by manipulating the elongated portion; in effect, simulating an initial imparted spin of the spheroid prior to contact with the student's racket; and thereafter showing the student a resulting imparted spin on the spheroid after contact with the student's racket. In slow motion, instructors can simulate the movement and the initial imparted spin and the resulting imparted spin due to striking a tennis ball in a very particular manner. In this context, slow motion is understood to be the speed at which the instructor causes the target object to move by manipulating the tennis teaching tool. The instructor can even hold the tool stationary, simulating a ball frozen in flight.

Other features, aspects, and advantages of the present invention will become better understood with reference to the following drawings, description and claims.

DETAILED DESCRIPTION OF THE INVENTION

The following detailed description is of the best currently contemplated modes of using exemplary embodiments of the invention. The description is not to be taken in a limiting sense but is made merely for the purpose of illustrating the general principles of the invention, since the scope of the invention is best defined by the appended claims.

Broadly, an embodiment of the present invention provides a teaching tool for use by an instructor teaching proper footwork and effective swing techniques to students of the game of tennis; this teaching tool applies as well to other racket-based sports. The teaching tool comprises an elongated member and a mounting member extending approximately perpendicularly from the distal end of the elongated member. A target object is connected to the distal end of the mounting member. The target object and distal end of the elongated member may be separated by a relatively short target distance defined, in large part, by the size of racket the student is using. In use, the instructor can directly and selectively control the movement of the target object to simulate imparted spin and motion of the target object before and after the student strikes the target object.

Figure 1:
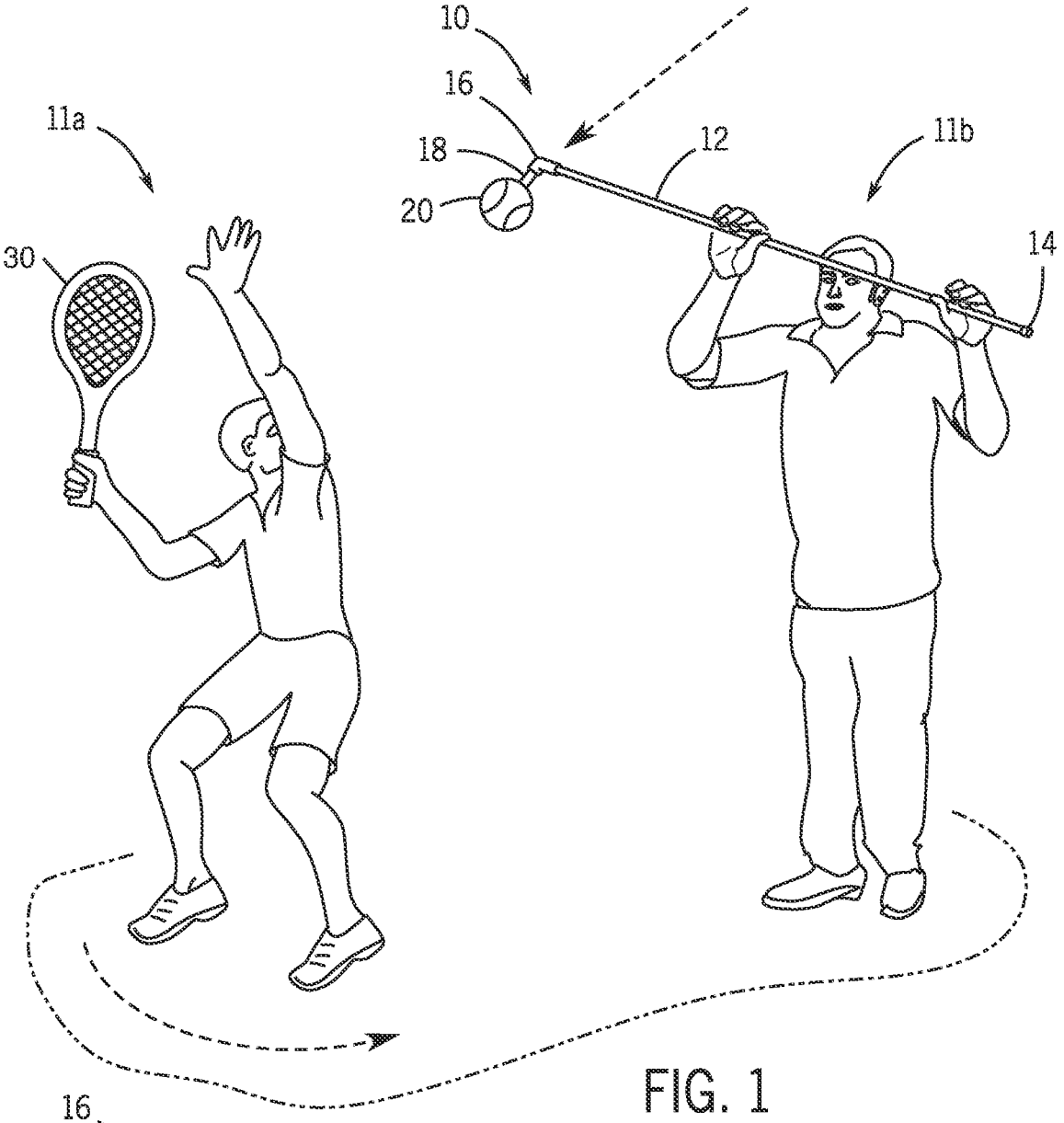
FIG. 1 is a perspective view of an exemplary embodiment of the present invention, shown in use.
Figure 2:
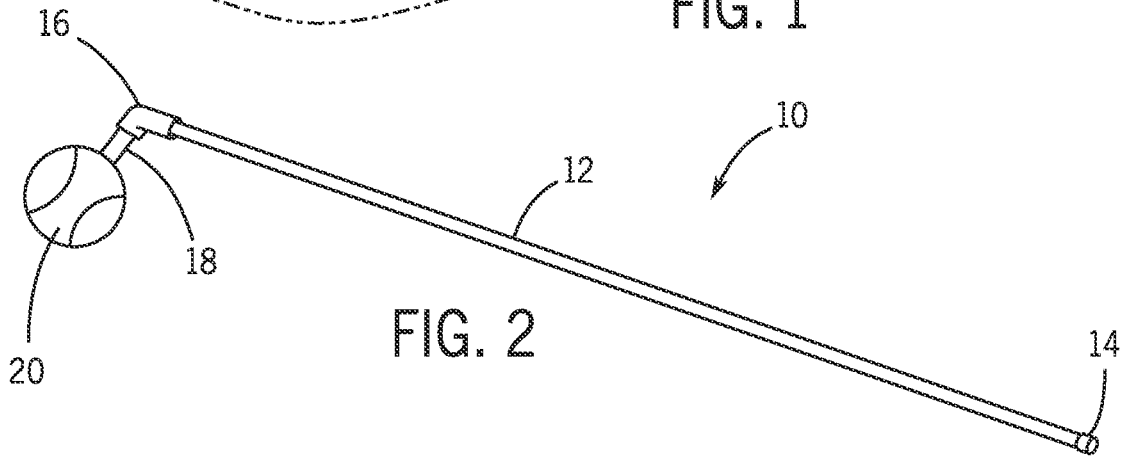
FIG. 2 is a perspective view of an exemplary embodiment of the present invention.
Figure 3:
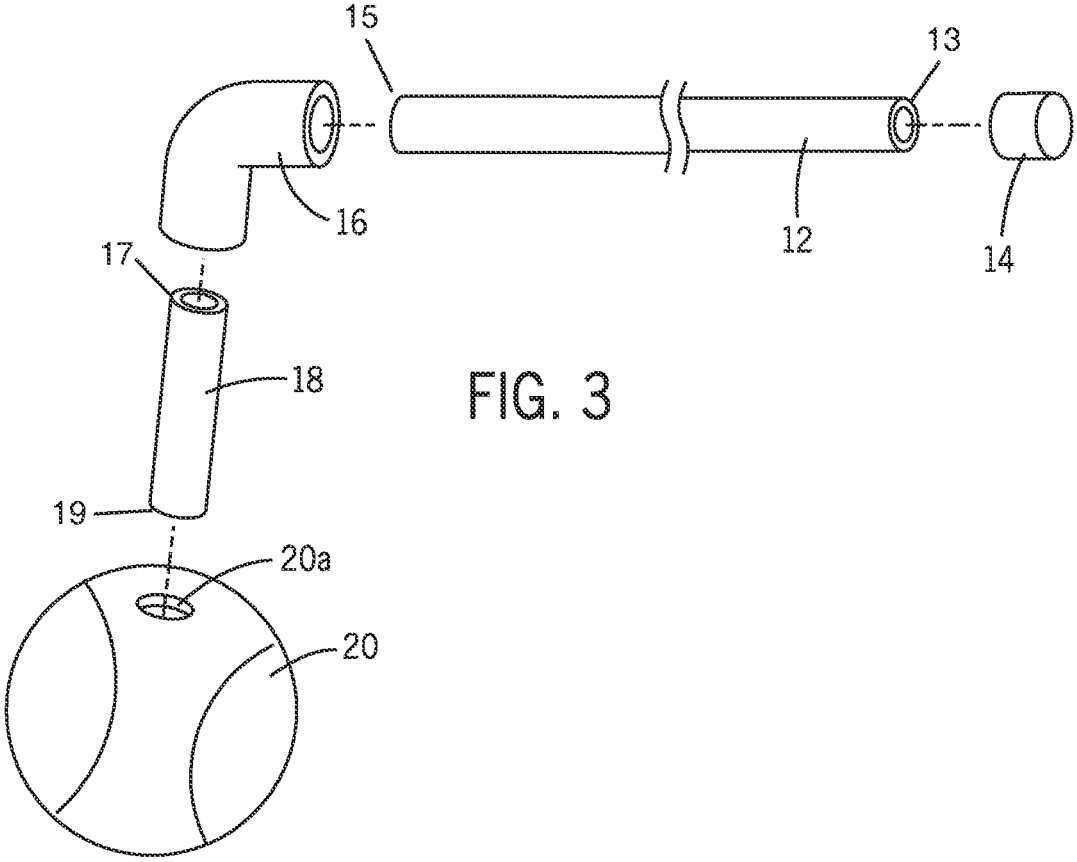
FIG. 3 is an exploded perspective view of an exemplary embodiment of the present invention.
Figure 4:
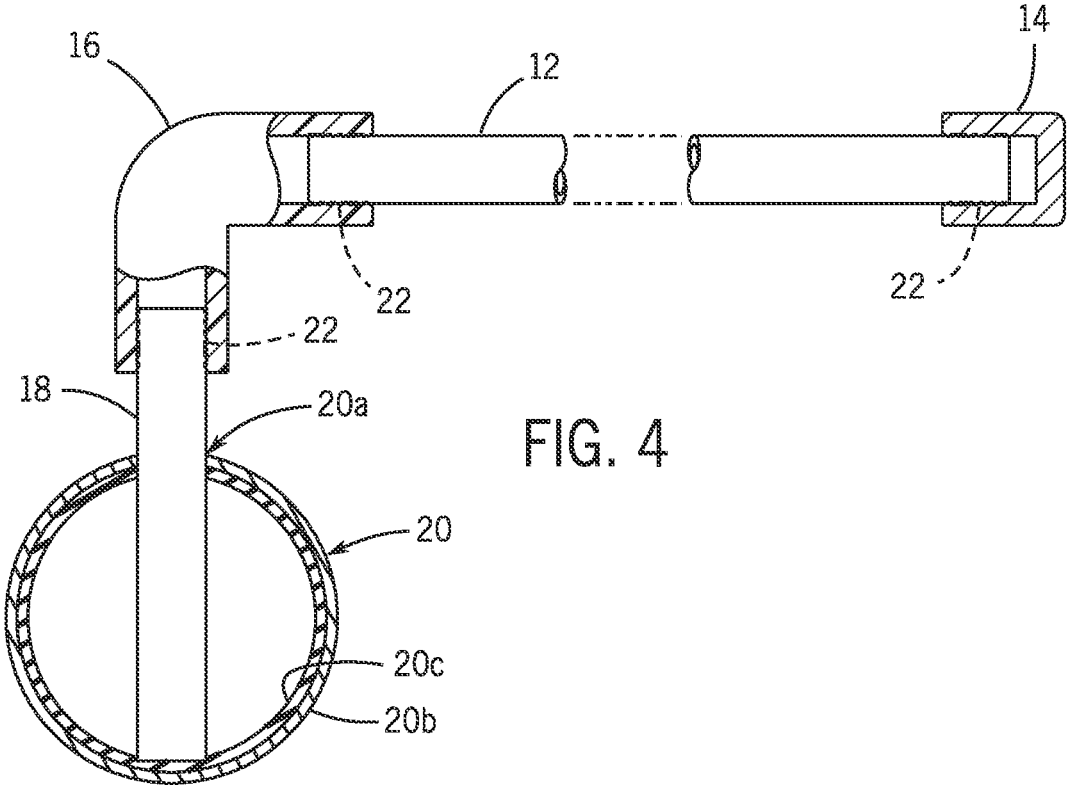
FIG. 4 is a side elevation view of an exemplary embodiment of the present invention, with some of the components shown in cross section.

Referring now to FIGS. 1 through 4, the present invention may be defined as a tennis teaching tool 10. The tennis teaching tool 10 may include an elongated member 12 extending between a proximal end 13 to a distal end 15. Elongated is understood to include a member 12 having a length of approximately 46 inches.

A cap 14 may be dimensioned to engage and cover the proximal end 13. The distal end 15 may connect to an elbow 16. Alternatively, the elongated member 12 could provide a curvature that transitions from the general linearity of the elongated member 12 to a mounting member 18 oriented between ten degrees to one hundred and seventy degrees relative to the elongated member 12. It is also understood that the elongated member 12 need not be linear throughout its entire length to function as disclosed herein. In some embodiments, the elongated member 12, the curvature, and the mounting member 18 may all be a unitary construction or, alternatively, more than three modular pieces. Modular pieces, e.g., the elongated member 12, the elbow connector 16, the mounting member 18, and the like, may be adhered together through adhesives 22 or other joining methods.

A proximal end 17 of the mounting member 18 is operatively associated with the elbow connector 16 (or in other embodiments, the above-mentioned curvature), while the distal end 19 of the mounting member 18 operatively associates with the target object 20. A target distance between the distal ends 15 of the elongated member and the target object 20 may be dimensioned and adapted to facilitate sufficient clearance between the elongated member 12 and the target object 20 so that, in certain embodiments, a student 11*a* may simulate hitting the target object 20 with their racket 30 without contacting the elongated member 12. The target distance may be between one and twenty-four or more inches. It is contemplated, though not shown in the figures, that the target distance may be selectively adjusted by the user/instructor 11*b*.

The target object 20 may be a modified regulation tennis ball or a replica thereof. The target object 20 may be a spheroid. By spheroid, it is understood that the target object is spherical through not necessarily a perfect sphere, much like a tennis ball is spherical but not a perfect sphere (though in some embodiments, the spheroid/spherical target object could be a perfect sphere). The target object has a hole 20*a* for slidably receiving the distal end 19 of the mounting member 18 in such a way that said distal end 19 passes through a cover 20*b* and core 20*c* of the target object 20/tennis ball. In other embodiments, the distal end 19 of the mounting member 18 may connect to the exterior surface of the target object 20.

The above-mentioned components may be made of durable lightweight material that is resistant to fracture and has the ability to yield under loading without fracturing, including but not limited to polyvinyl chloride (PVC) piping. The material may have a modulus of elasticity ranging between 0.00300-4.83 GPa (0.435-700 ksi (English units); a flexural yield strength ranging between 28.0-99.9 MPa (4060-14500 psi, English units); and a flexural modulus ranging between 1.30-4.69 GPa (188-680 ksi, English units).

The lightweight material enables the present invention to be used by tennis instructors 11*b* without producing muscular fatigue. The tool 10 can also be easily rotated into different positions to simulate the effects of hitting a moving tennis ball. The modulus of elasticity of the lightweight material used to produce this tool is a major advantage over other materials, because tennis instructors can feel the angle of attack that a student uses when striking the target object 20 with the racket 30. Additionally, the lightweight material properties allows that if it is struck by the tennis racket 30, the elongated member 12 or the mounting member 18 will not fracture or produce dangerous flying fragments, as might a wooden tool, or a tool made with soft plastic.

The tool's length may be optimized for portability and usability, especially for when players cannot practice on a tennis court. The tool's length enables the instructor 11*b* to stay in place while the student 11*a* moves to practice footwork, as well as forehand, backhand, overhead, underhand, and ambidextrous techniques.

In certain embodiments, the tennis teaching tool 10 may have a length of forty-six-inches, thereby minimizing any possibility of warping over prolonged repeated use. It being understood that the length may be greater or less then forty-six inches.

PVC is a good choice for the lightweight material because PVC material is non-toxic and is also the world's most researched and tested plastic. PVC material is also difficult to ignite, making it a safe tool even if it is put near a heat source. PVC material is impervious to water damage and damage from the elements such as rain, snow, or mud. And PVC design allows the tennis ball to be replaced if and when needed.

The tennis teaching tool 10 is also simple to construct if a manufacturer uses PVC material and has experience measuring, cutting, and gluing PVC piping and PVC material. One would also have to have skill and experience cutting a hole into a tennis ball to the correct diameter. That being said, the steps to make the tennis teaching tool 10 may include the following: Step 1) Purchase or acquire the materials (e.g., the ½-inch PVC End Cap, ½-inch PVC Pipe (greater than 50 inches), ½-inch PVC 90 Degree Elbow, PVC cement, and a Tennis Ball). Step 2) Measure and cut, in certain embodiments, a forty-six-inch length of PVC piping, and an approximately three-inch length mounting member 18 to be used to attach the tennis ball to the tool. Step 3) Attach with PVC cement the end cap 14 to the proximal end 13 of the elongated member 12 PVC piping. Step 4) Attach with PVC cement the PVC 90 Degree Elbow to the other end of the forty-six-inch length of PVC piping. Step 5) Attach with PVC cement the three-inch PVC pipe to the other end of the PVC 90-degree elbow 16. Step 6) Cut a hole into the tennis ball with a diameter of ½ half. Step 7) Press the tennis ball into the other end of the three-inch PVC pipe. Do not attach the ball with PVC cement, as it will stay attached and, should the ball loosen, it can be easily pressed back into place so that the inner rubber 20*b* of the ball (opposite the hole) is pressed against the PVC piping. This allows for a new tennis ball to be cut and attached if ever needed. A rubber padding could be added to the tool's "handle" to absorb shock, but we found it to be unnecessary.

A method of using the present invention may include the following. The tennis teaching tool 10 disclosed herein may be provided and used as follows: the target object 20 end of the tennis teaching tool 10 would be extended away from the tennis instructor's 11*b* body. The student 11*a* would be told to slowly and carefully hit the ball with his or her racket 30. The tennis instructor 11*b* would observe the student's footwork, balance, and tennis stroke to determine where improvements are needed. The instructor 11*b* can take several steps to the right or to the left to help the student improve his or her footwork with respect to approaching an incoming ball. At all times, the instructor 11*b* should hold on to the "handle"/elongated member 12 with two hands and not allow the student to make violent swings, but, instead, carefully controlled swings with clear intent to impart topspin, back-spin, minimal-spin, or a combination of topspin and sidespin, or backspin and sidespin, commonly known as "slicing" the ball.

Critically, the curvature and/or elbow 16 and/or target distance isolates the target object 20 so it can be hit by the racket 30 and enables/facilitates the simulation of centripetal motion by way of student-imparted spin on the target object 20. Critically, the target object 20 is not rotatably connected to the mounting member 18.

As used in this application, the term "about" or "approximately" refers to a range of values within plus or minus 10% of the specified number.

It should be understood, of course, that the foregoing relates to exemplary embodiments of the invention and that modifications may be made without departing from the spirit and scope of the invention as set forth in the following claims.

What is claimed is:

1. A method of teaching a stroke of a racket, the method comprising:

providing a tennis tool comprising:

an elongated portion made from polyvinyl carbonate (PVC), and the elongated portion having a length of approximately forty-six inches;

a mounting portion made from PVC extending approximately perpendicularly from a distal end of the elongated portion;

an elbow connector made from PVC interconnecting the elongated portion and the mounting portion;

an adhesive adhering the elbow connector to the elongated portion and the mounting portion;

an end cap attached to a proximal end of the elongated portion; and a spheroid connected to a distal end of the mounting portion, wherein a target distance of approximately three inches separates the spheroid and the distal end of the mounting portion, wherein the spheroid has a hole slidably receiving the distal end of the mounting portion, and wherein there is no pivotable connection between the spheroid and the mounting portion; and simulating a movement of the spheroid through manipulating the elongated portion.

2. The method of claim 1, further comprising simulating an initial imparted spin of the spheroid prior to contact with the racket.

3. The method of claim 2, further comprising simulating a resulting imparted spin of the spheroid after contact with the racket.

4. The method of claim 3, further comprising simulating the movement and the initial imparted spin and the resulting imparted spin in slow motion.

* * * * *